US005765330A

United States Patent [19]

Richard

[11] Patent Number: 5,765,330

[45] Date of Patent: Jun. 16, 1998

[54] PRE-INSULATED PREFAB WALL PANEL

[76] Inventor: Michel V. Richard, Rte. 134, P.O. Box 250, St. Louis, New Brunswick, Canada, E0A 2Z0

[21] Appl. No.: 693,791

[22] Filed: Jul. 31, 1996

[51] Int. Cl.[6] ..... E04C 2/24; E04B 1/00

[52] U.S. Cl. ..... 52/309.13; 52/309.16; 52/265; 52/284; 52/270; 52/407.3; 52/483.1; 52/742.1; 52/745.19

[58] Field of Search ..... 52/309.4, 309.5, 52/309.7, 309.8, 309.13, 270, 284, 483.1, 407.3, 742.1, 742.13, 745.09, 745.1, 745.19, 309.16, 265, 264

[56] References Cited

U.S. PATENT DOCUMENTS

| | | | |
|---|---|---|---|
| 3,258,889 | 7/1966 | Butcher | 52/407.3 X |
| 3,641,724 | 2/1972 | Palmer | 52/407.3 X |
| 3,879,240 | 4/1975 | Wall | 52/309.8 X |
| 3,965,635 | 6/1976 | Renkert | 52/309.7 X |
| 4,109,436 | 8/1978 | Berloty . | |
| 4,602,466 | 7/1986 | Larson . | |
| 4,628,650 | 12/1986 | Parker . | |
| 4,653,246 | 3/1987 | Hepler . | |
| 4,774,119 | 9/1988 | Imhoff | 52/309.7 X |
| 4,856,244 | 8/1989 | Clapp | 52/309.7 |
| 4,914,883 | 4/1990 | Wencley | 52/309.5 |
| 4,981,003 | 1/1991 | McCarthy | 52/309.7 |
| 5,353,560 | 10/1994 | Heydon . | |
| 5,353,563 | 10/1994 | White | 52/309.13 |
| 5,425,908 | 6/1995 | Merser | 52/309.5 X |

FOREIGN PATENT DOCUMENTS

| | | |
|---|---|---|
| 1208871 | 8/1986 | Canada . |
| 1284712 | 6/1991 | Canada . |

*Primary Examiner*—Robert Canfield
*Attorney, Agent, or Firm*—Mario D. Theriault

[57] ABSTRACT

A pre-insulated prefab wall panel comprising of a rectangular wall frame having top and bottom rail members and a plurality of spaced apart stud members aligned between the top and bottom rail members. A polystyrene boardstock is affixed to a first side of the rectangular wall frame, thereby defining with the top and bottom rail members and the plurality of stud members a plurality of rectangular cavities, wherein each cavity has a depth of the thickness of a stud member. The prefab wall panel further has a layer of foamed-in-place polyurethane covering a portion of each cavity adjoining the boardstock, and bonding the structural wall frame to the polystyrene boardstock. The layer of polyurethane foam has a thickness which is substantially less than the depth of each cavity, whereby each cavity has available space for accommodating sub-trade installations.

19 Claims, 4 Drawing Sheets

PRE-INSULATED PREFAB WALL PANEL

FIELD OF THE INVENTION

The present invention relates to a pre-insulated prefab wall panel to build a prefab house, and more particularly, the present invention relates to a pre-insulated prefab wall panel having available space between the studs for the running of electrical wiring and plumbing therein.

BACKGROUND OF THE INVENTION

Prefab wall panels, prefab roof trusses and plywood sheathing are often used to erect a house in a very short time with few workers. Prefab building components are normally preferred by the construction industry as they are assembled with approved materials, according to controlled procedures and under the ideal conditions of a well equipped shop. For these reasons, houses built with prefab components are generally of a better quality than conventional structures built outdoors on a construction site.

An important aspect of the quality of a house is the thermal resistance of its structure. In that respect, home builder associations as well as writers of national building codes specify a minimum level of insulation to be installed in walls, ceilings and around foundations of new houses. Normally the insulation requirement for the walls of a house built in Canada for example, varies between R-16 and R-27 depending on the number of degree-days of a particular region.

A typical conventional prefab wall panel having an insulation value of R-20 is built with nominal 2"×6" wood framing members covered on the outside surface with panels of half-inch plywood or particleboard, half-inch fibreboard sheathing and an exterior cladding. The space between the stud is completely filled with batt type fibreglass insulation. The interior finish may comprise another half-inch fibreboard insulation and a gypsum board. This type of prefab wall panel is usually fabricated and transported to a construction site without the batt insulation, interior finish and exterior cladding.

A drawback of this type of construction is the fact that each wall panel is relatively heavy to handle and erect on a floor structure. Also, the batt insulation is still installed in the usual manner, when the new building is closed-in.

As alternatives to the R-20 nominal 2"×6" wall structure, a number of different types of prefab wall panels are made with a solid foam core encapsulating a smaller wood frame. A first example of pre-insulated wall panel having a foam core is described in U.S. Pat. No. 4,109,436 issued on Aug. 29, 1978 to Adrien Berloty. This building panel comprises a wood frame which is completely filled with foam. The foam forms a rigid block which adheres to the frame. The continuity of the foam block in the frame give the panel a good stability as well as excellent thermal insulation.

A second example of a prefab wall panel having a foam core is disclosed in the U.S. Pat. No. 4,628,650 issued on Dec. 16, 1986 to Bert A. Parker. The document describes a structural insulated panel system comprising a foam core having channels for receiving framing studs or rafters. The foam core also has an overhanging portion around its periphery for overlapping the framing members along the edges thereof. The foam core completely covers the framing members for efficiently sealing the wall from infiltration of cold air inside the building.

A third example of a wall section having a foam core is illustrated and described in the U.S. Pat. No. 5,353,560 issued on Oct. 11, 1994 to John J. Heydon. This invention discloses a plurality of preformed foam blocks, wherein each block is fitted between two adjacent vertical posts of a wall section. Each block has a recess along the edge thereof for encapsulating one post and for overlapping a portion of an adjacent foam block. The plurality of interlocked foam blocks encapsulates completely all posts of a wall framing.

Although a solid foam core has been preferred in the past for obtaining high insulation value with a relatively thin wall section, the foam core takes up all the hollow space between the wall studs. Sub-trade workers such as electricians and plumbers must use hot knives for cutting grooves through the foam core for running plumbing piping and manifolds or an electrical system into the insulated wall section.

For this reason, the work saved by carpenters for erecting a foam filled wall structure is often offset by the additional manpower required by sub-trade workers for grooving the insulation. Hence, a need exists in the industry for a pre-insulated prefab wall panel offering excellent thermal resistance as well as being structurally compatible to the requirement of all tradesmen involved in the construction of a building.

SUMMARY OF THE INVENTION

In the present invention, however, there is provided a pre-insulated prefab wall panel which is light in weight, has high insulation properties, and which has large spaces between the wall studs for accommodating sub-trade installations.

In one aspect of the present invention, the pre-insulated prefab wall panel comprises a rectangular wall frame having top and bottom rail members and a plurality of spaced apart stud members aligned between the top and bottom rail members.

The prefab wall panel also has a polystyrene boardstock affixed to a first side of the rectangular wall frame, thereby defining with the top and bottom rail members and the plurality of stud members, a plurality of rectangular cavities wherein each cavity has a depth of a thickness of a stud member.

The prefab wall panel further has a layer of polyurethane foam covering a portion of the cavities adjoining the boardstock. The layer of polyurethane foam has a thickness which is substantially less than a depth of each cavity, whereby the cavity has available space for running electrical wiring and plumbing there through.

A first advantage of the prefab wall panel of the present invention is that the thickness of polyurethane insulation required in addition to the polystyrene boardstock, to provide an average regulatory insulation requirement, is substantially less than a depth of each cavity. In fact a thickness of polyurethane of 1" to 1½" with a polystyrene boardstock of 3" thick provides a thermal resistance of about between R-18 to R-21.

The remaining 2" to 2½" of available space between the studs is deep enough for accommodating for example an electrical receptacle box or a vent or drain pipe of a plumbing system. Therefore, although the prefab wall of the present invention is pre-insulated at the factory, it does not add to the work of sub-trade workers at the construction site.

In accordance to another aspect of the present invention, there is provided a top plate member affixed in a temporary fashion to the rectangular wall frame, over the top rail member. This top plate member is substantially similar in length and cross-section as the top rail member.

In this other aspect of the present invention, the polystyrene boardstock extends along the height of the rectangular wall frame below the bottom rail member a distance of about between 12" and 14" for overlapping a floor structure for example, and above the top rail member a distance of about the thickness of the top plate member.

The top plate member protects the polystyrene boardstock when the prefab wall panel of the present invention is manipulated in a vertical orientation and laid on its upper edge. Such a manipulation of the prefab wall panel in a vertical and up-side down orientation provides an efficient method for lifting the panel from a manufacturing table, for storing several panels stacked against one-another along a supporting wall, and for handling the panels onto and off a transport trailer. The top plate member may be taken off the wall panel at the construction site and re-installed in a manner to overlap two adjoining panels, as is customary in the carpentry trade.

In accordance to a further aspect of the present invention, there is provided a new and efficient method for manufacturing a pre-insulated prefab wall panel. The new method comprises the steps of assembling an opened structural wall frame on a horizontal flat surface, applying a first bead of polyurethane foam on a periphery of the structural wall frame, and covering the structural wall frame with a polystyrene boardstock having a thickness of about 3".

The method further comprises the steps of fixing the boardstock to the structural wall frame with a plurality of strap members and nails through the strap members, through the boardstock and into the structural wall frame. The structural wall frame is then turned upwardly in a generally vertical orientation, and a layer of polyurethane foam having a thickness of about between 1" and 1½", is sprayed through the opened structural wall frame and against an underside of the boardstock.

The pre-insulated prefab wall panels manufactured by this method are structurally rigid and strong whereby they are transported and erected on a floor structure without using diagonal bracing.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
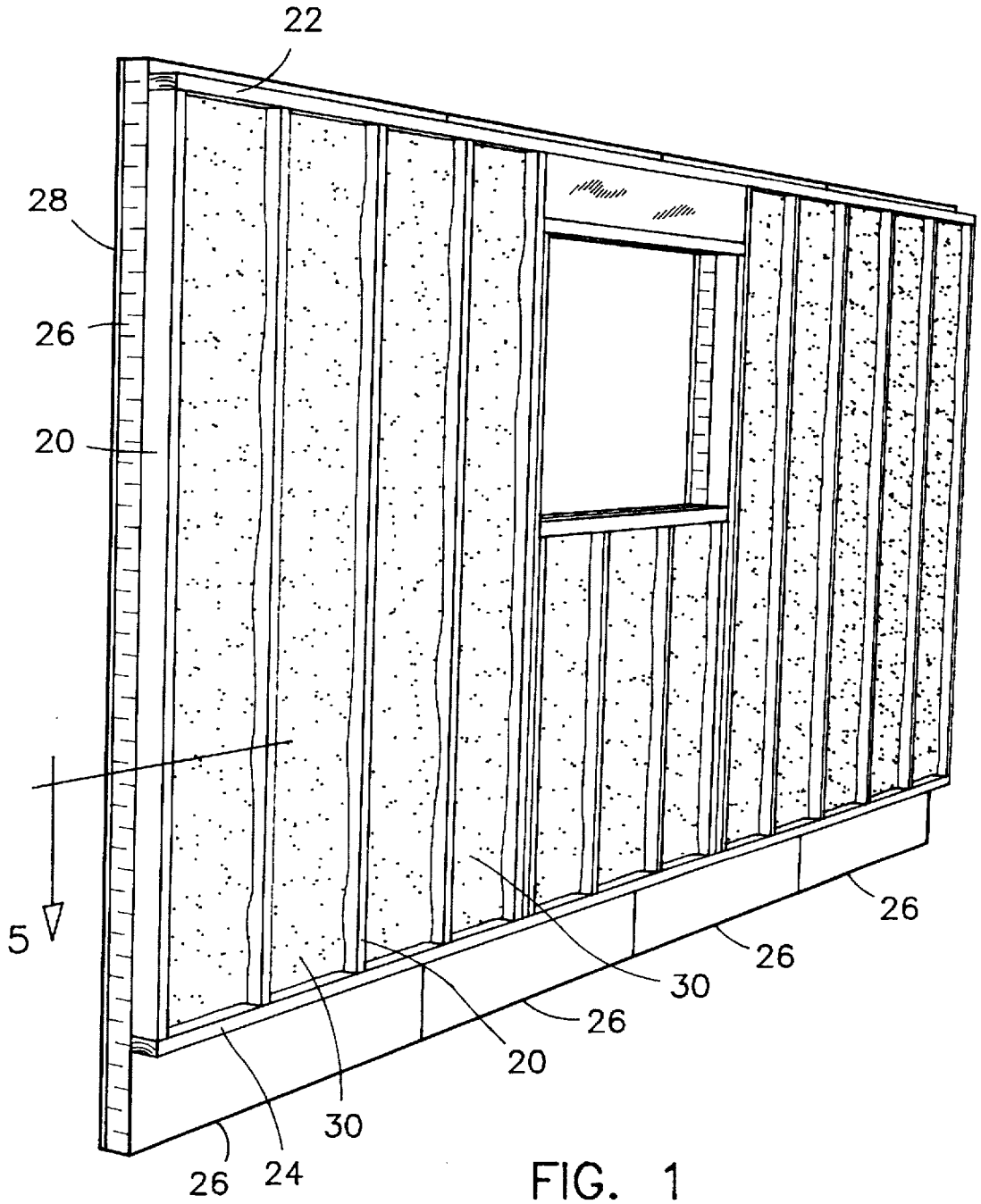
FIG. 1 is a perspective inside side and end view of a pre-insulated prefab wall panel of the preferred embodiment.

Referring to FIG. 1, the pre-insulated prefab wall panel of the preferred embodiment has a wood structure made of nominal 2"×4" members. The structure comprises vertical studs 20 spaced at 16" intervals, and top and bottom rail members 22, 24. The pre-insulated prefab wall of the preferred embodiment, as is illustrated in FIG. 1 typically has a length of 16 ft., and a wood frame height of 95¾", measured between the top rail 22 and bottom rail 24.

The wood structure, is entirely covered on its outside surface by four (4) juxtaposed boards of Expanded Polystyrene (EPS) 26 having a thickness of 3". The EPS boards 26 extend above the top rail 22 a distance of a top plate, and below the bottom rail 24, a distance sufficient for overlapping a thickness of a floor structure, as will be explained later.

Although Expanded Polystyrene is a recommended material for building the prefab wall panel of the preferred embodiment, a person knowledgeable of foam insulation will realize that an Extruded Polystyrene may be more appropriate in certain circumstances.

The EPS boards 26 are retained to the wood structure by wood straps 28 and nails through the wood straps, through the boards 26 and into the wall studs 20. The pre-insulated prefab wall panel further comprises foamed-in-place polyurethane 30 between the studs 20 and against the EPS boards 26. The preferred thickness of polyurethane foamed is between 1" and 1½". The 3" thick EPS boards 26 with 1½" of foamed in place polyurethane 30 typically provides a thermal resistance of about R-12 and R-9 respectively.

A further advantage from using a polyurethane foam 30 between the wall studs 20 is that the foam provides a strong bond between the wood frame 20,22,24 and the EPS boards 26. This bond in combination with the nailed straps 28 increases the structural strength and stiffness of the panel and maintains its squareness. Diagonal bracing of corners is therefore not required. The pre-insulated prefab wall panel of the preferred embodiment is relatively light and may be manipulated and erected by two workers with ease and assurance.

For comparison purposes, a typical wall panel as just described and illustrated, but without a window frame, weights in the proximity of 240 lbs, while a conventional R-20 prefab wall panel having the same length and height, built with 2"×6" wood structure and covered by ½" plywood, weights nearly 440 lbs. For comparable insulation value, the prefab wall panel of the preferred embodiment has 45% less material weight than the conventional 2"×6" prefab wall. Thus, the lighter prefab wall panel of the preferred embodiment is handled and installed more efficiently than the conventional nominal 2"×6" wall structure.

Figure 3:
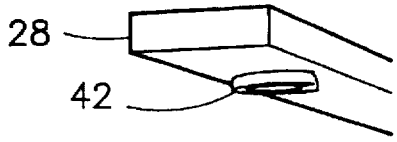
FIG. 3 is an enlarged view of Detail 3 in FIG. 2, illustrating a foam bead on the underside of a wood strap used in the construction of the prefab wall panel of the preferred embodiment.
Figure 2:
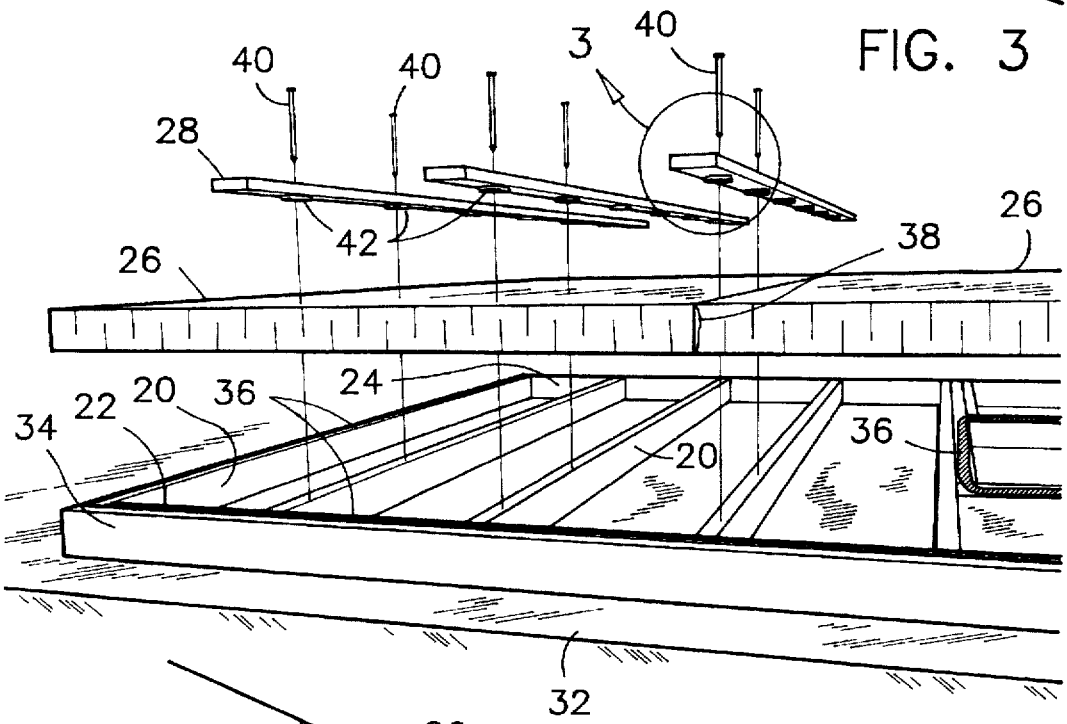
FIG. 2 illustrates various steps comprised in construction of the prefab wall panel of the preferred embodiments.
Figure 4:
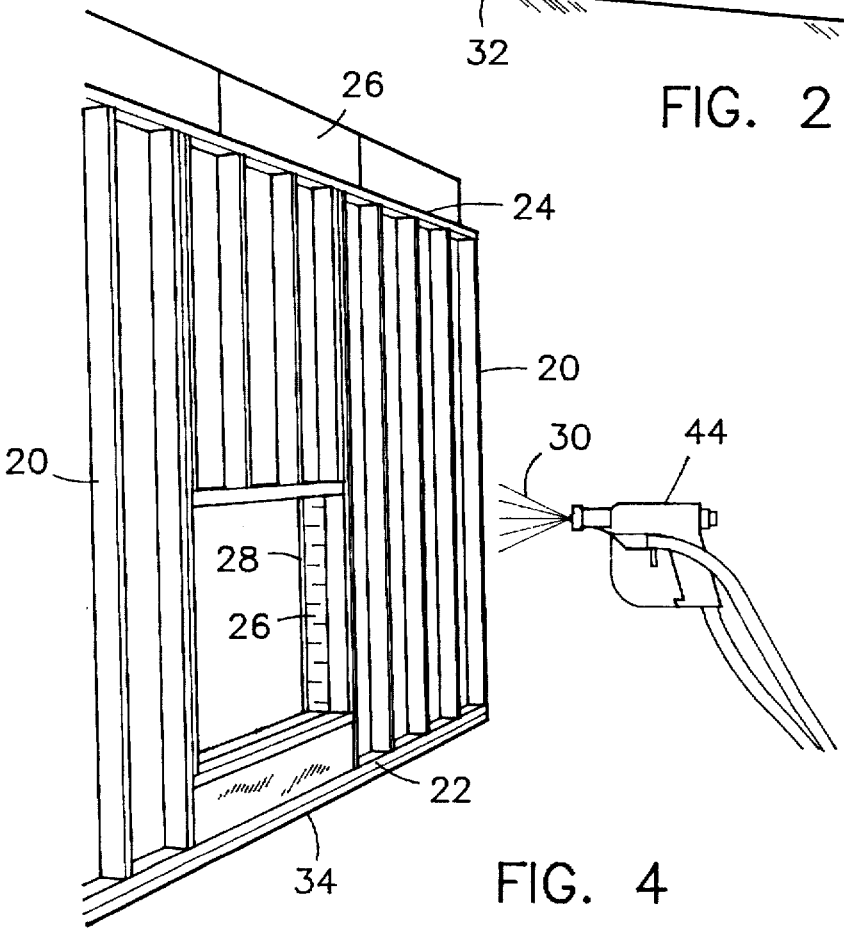
FIG. 4 illustrates a final step comprised in the construction of the prefab wall panel of the preferred embodiment.

Referring now to FIG. 2, 3 and 4, there is illustrated a recommended method for fabricating the prefab wall panel of the preferred embodiment. The method comprises firstly the step of assembling a wood structure on a flat surface 32. The wood structure comprises vertical studs 20, a top rail 22, a top plate 34, and a bottom rail 24. The top plate 34 is attached to the top rail 22 in a temporary fashion, such that it can be taken out during the erection of these panels on a floor structure, and reinstalled in a manner to overlap two adjoining wall panels.

The top plate 34 protects the top edge of the EPS boards 26 during the handling and transporting of the prefab wall panel to a construction site. For this reason, the prefab wall panel is preferably manipulated and laid on its upper edge as often as possible until it is ready to be installed in place.

Once the wood frame is assembled on a work table 32, a bead of polyurethane foam 36, preferably from a spray can, is sprayed around the periphery of the frame and around window openings, such as illustrated on FIG. 2. One type of polyurethane foam sold in a spray can is marketed under the trade name ENERFoam™ by Abisko Manufacturing Inc. in Richmond Hill, Ontario, Canada.

A third step for manufacturing the prefab wall panel of the preferred embodiment is to apply another bead of foam 38, as partly seen on FIG. 2, along the edge of an EPS board adjoining another EPS board 26. Both foam beads 36 and 38 provide an effective seal between the EPS boards 26 and the wood frame, to prevent infiltration of air through the wall.

The EPS boards 26 are then affixed to the wood frame and retained in place by wood straps 28 and nails 40 through the wood straps 28, the EPS boards 26 and into the wall studs 20. The wood straps 28 have pre-drilled holes (not shown) at spaced intervals. Each pre-drilled hole preferably has a diameter which is less than the diameter of nail 40.

Prior to installation of the wood straps 28 onto EPS boards 36, the pre-drilled holes are preferably encircled by a further bead foam 42 as illustrated in FIG. 3. This further bead of foam 42 is placed on the underside of each wood strap 28 to prevent infiltration of air underneath the wood straps 28, along the nails 40 and through the EPS boards 26.

A further step in manufacturing a prefab wall panel of the preferred embodiment, is to apply a layer of polyurethane foam 30 in all cavities defined by the wall studs 20, top and bottom rails 22,24 and the EPS boards 26. During this operation, the wall panel is preferably raised in a vertical position on its upper edge as shown in FIG. 4, and the polyurethane foam 30 is applied using a spray gun 44 as is customary in the insulation industry.

As it was mentioned earlier, the top plate 34 protects the upper edge on the EPS boards 26 when the prefab wall is raised in this vertical position, and for example when it is manipulated out of the fabrication shop and onto a transport trailer for example.

Figure 6:
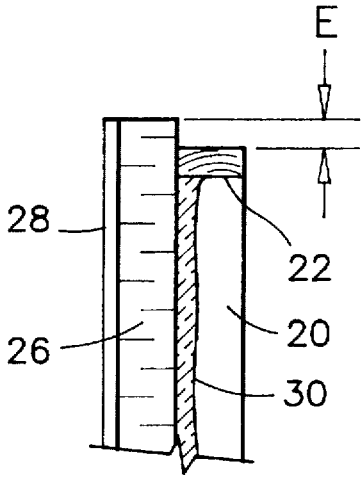
FIG. 6 is an enlarged view of Detail 6 on FIG. 5, illustrating recommended dimensions for the prefab wall panel of the preferred embodiment.
Figure 6:
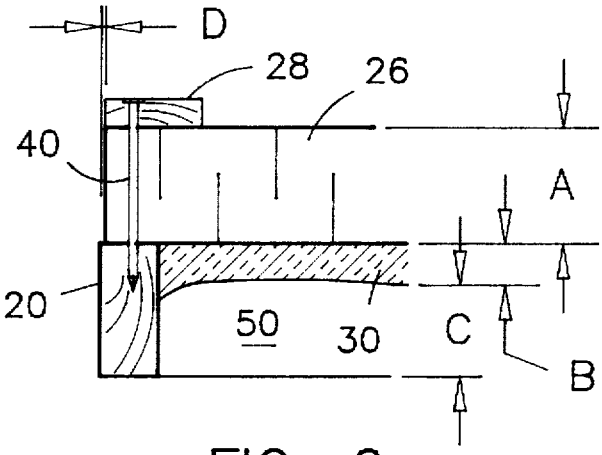
Figure 5:
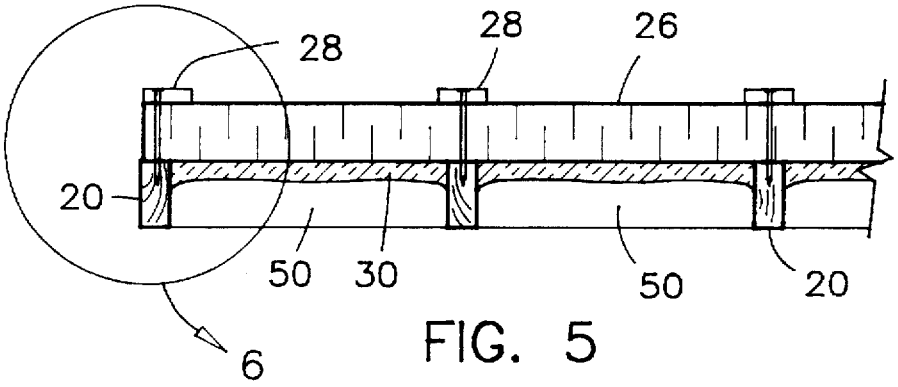
FIG. 5 is a cross-section of the prefab wall panel of the preferred embodiment viewed through line 5 on FIG. 1.

Referring now specifically to FIGS. 5 and 6, the prefab wall panel of the preferred embodiment is covered by an EPS board 26 having a thickness 'A' of about three inches (3") as also mentioned earlier. The thickness 'B' of the polyurethane foam 30 is preferably about 1" to 1½". This arrangement leaves an empty space 50 having a depth 'C' of about 2" to 2½" between the studs 20 and along the entire height of the wood structure. The depth 'C' of this empty space is sufficient for running electrical wiring or plumbing installations therein without having to gouge into the polyurethane foam, as is required with wall panels of the prior art having solid foam cores.

The total width of all the EPS boards 26 is preferably smaller than a total width of the wood frame such that a gap is left opened between the EPS boards 26 of any two wall panels installed side-by-side. The total width of all the EPS boards 26 is preferably less than the width of the wood frame, by a reduction dimension 'D' of about ⅛" at both vertical edges of each wall panel.

Figure 8:
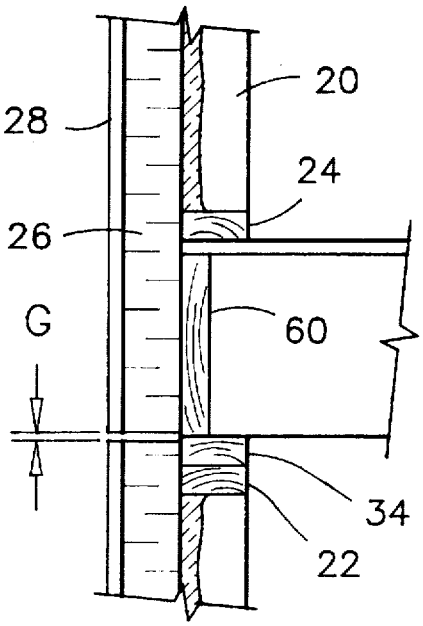
FIG. 8 is a vertical cross-section of the prefab wall panel of the preferred embodiment at the intersection of two storeys of a building.
Figure 7:
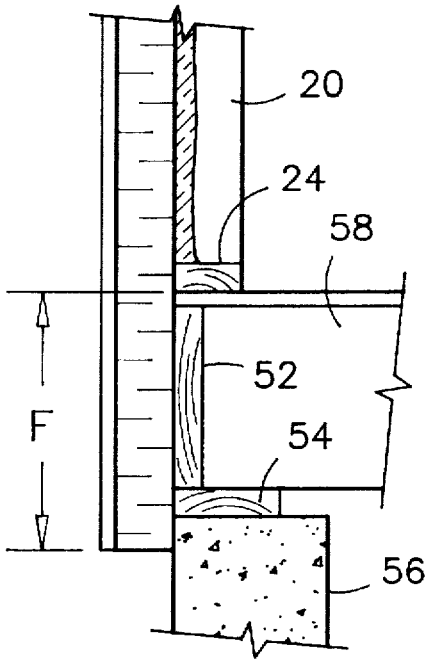
FIG. 7 is a vertical cross-section of the prefab wall panel of the preferred embodiment installed on a floor structure.

Referring now to FIGS. 7 and 8, the top portion of the EPS boards 26 preferably extends above the wall framing by a distance as shown as 'E' of about the thickness of a top plate 34 such that when the top plate 34 is installed atop the top rail 22, the EPS boards 26 project over this top plate 34.

The lower portion of the EPS boards 26 extends below the bottom rail 24 a distance 'F' which is sufficient for covering the rim joist 52, the sole plate 54 and the upper edge of a foundation wall 56, to prevent infiltration of air along the floor structure. This distance 'F' is normally about 12" and preferably up to 14" for floor joists 58 having a nominal depth of 10" for example.

Referring particularly to FIG. 8, there is illustrated two prefab wall panels of the preferred embodiment installed on top of one-another, forming a wall of a two storey building for example. In this embodiment, the EPS boards 26 are sized to cover the rim joist 60 while leaving a horizontal gap 'G' between the superimposed prefab wall sections. This gap is later filled with polyurethane foam in a spray can, such as the product specified earlier.

Figures 9, 10:
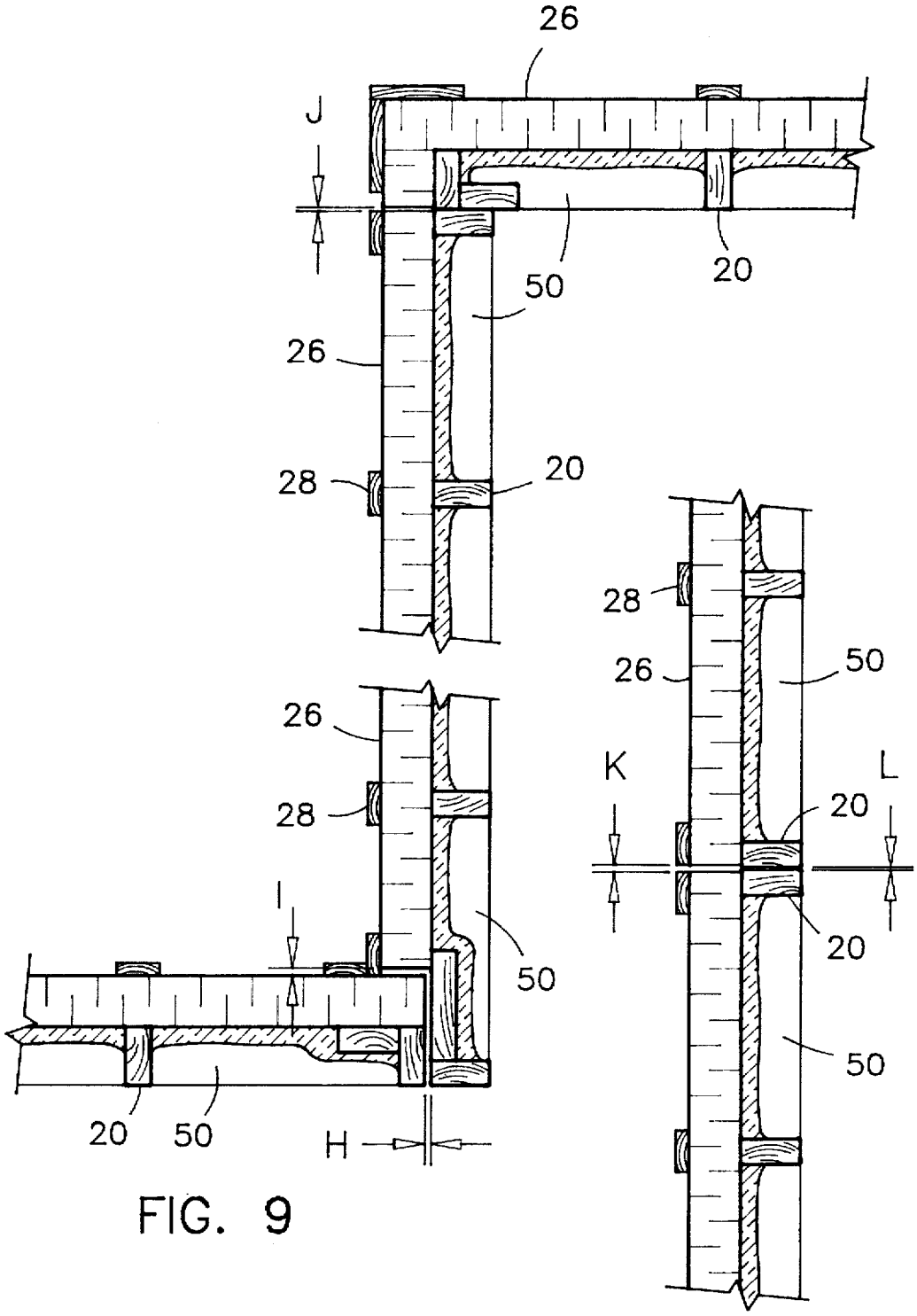
FIG. 9 is a horizontal cross-section of the prefab wall panel illustrating a preferred arrangement for an inside corner and for an outside corner of a wall.
FIG. 10 is a further horizontal cross- section or two adjoining prefab wall panels.

The same product is preferable used to seal vertical gaps along adjacent prefab wall panels of the preferred embodiment. Accordingly, FIGS. 9 and 10 illustrate the preferred gap thicknesses on an inside corner, an outside corner and a straight wall respectively.

During assembling these wall sections to form a building, a minimum gap of ⅜" should be left at the intersection of two wall sections, that is at all gaps indicated by labels 'H', 'I', 'J' and 'K'. Similarly, two bordering wall studs 20 at the intersection of two wall panels should be spaced apart a gap 'L' of about ⅛". The foam sprayed inside the gap 'K' seeps into the wall and between the bordering studs 20 providing an efficient seal against infiltrations of cold air between any two wall panels.

The general arrangement of the components of the prefab wall panels of the preferred embodiment together with the dimensions as shown at labels 'A' to 'L' provide a pre-insulated prefab wall structure which is easy to assemble and thermally efficient. More importantly, the structural arrangement of the wall panel of the preferred embodiment is compatible to the work and installations of sub-trade workers.

A further advantage of the wall panel of the preferred embodiment is that where additional insulation is required, the space 50 between the studs may be filled with a batt type fibreglass insulation having a thickness of up to 2". This insulation adds another R-6.5 to this wall and raises its thermal resistance to R-27.5. Moreover, the inside surface of the wall may be covered by a ½" gypsum board, thereby adding another R-0.4 of insulation. When an impermeable cladding is added on the outside surface of this prefab wall panel, thereby enclosing air spaces between the strap members 28, an additional R-0.75 to R-1.0 of insulation may be obtained from these air spaces, depending on the thickness of the strap members 28. Therefore the air spaces, the gypsum boards and the batt insulation raise the R value of this prefab wall to nearly R-29. In locations of severe climatic conditions, the thickness of the polystyrene boards may be increased to 4" or more to still substantially increase the insulation value of that prefab wall panel.

The prefab wall panel of the preferred embodiment is thereby convenient for building houses in a northern climate where insulation requirements are high. The prefab wall panel is convenient for building energy efficient houses without losing floor space inside the house as it is normally the case with the 6" thick conventional R-20 wall structure.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, construction features or the like. Therefore, the above description and the illustrations should not be construed as limiting the scope of the invention which is defined by the appended claims.

I claim:

1. A pre-insulated prefab wall panel for constructing prefab buildings, said pre-insulated prefab wall panel comprising:

a rectangular wall frame having a top and bottom rail members having each a longitudinal dimension defining a length of said frame and being spaced apart from one-another a distance defining a height of said frame, and a plurality of spaced apart stud members aligned between said top and bottom rail members;

a polystyrene boardstock affixed to a first side of said rectangular wall frame, thereby defining with said top and bottom rail members and said plurality of stud members a plurality of rectangular cavities, wherein each cavity has a depth equivalent to a thickness of one of said stud members; and a layer of polyurethane foam covering a portion of said cavities adjoining said boardstock;

said boardstock extending along said height of said rectangular wall frame below said bottom rail member a distance equivalent to about between 12" and 14" structure for preventing an infiltration of air along a floor when said pre-insulated prefab wall panel is installed on said floor structure.

2. A pre-insulated prefab wall panel as claimed in claim 1 wherein said boardstock is bonded to said first side of said rectangular frame by a first bead of polyurethane foam applied around a periphery of said first side.

3. A pre-insulated prefab wall panel as claimed in claim 2 wherein said boardstock comprises two juxtaposed rectangular boards bonded edge-to-edge to one-another by a second bead of polyurethane foam applied between the bordering edges of said boards.

4. A pre-insulated prefab wall panel as claimed in claim 1 wherein said layer of polyurethane foam has a thickness which is substantially less than said depth of said cavities, whereby each said cavity has available space for running electrical wiring and plumbing there-through.

5. A pre-insulated prefab wall panel as claimed in claim 1 wherein said boardstock also extends along said height of said rectangular frame above said top rail member a distance of about a thickness of said top rail member.

6. A pre-insulated prefab wall panel as claimed in claim 1 wherein said boardstock has a longitudinal dimension which is shorter than said length of said rectangular wall frame by a reduction dimension at each transversal edge of said rectangular wall frame.

7. A pre-insulated prefab wall panel as claimed in claim 6 wherein said reduction dimension is about ⅛".

8. A pre-insulated prefab wall panel as claimed in claim 2 wherein said boardstock is also affixed to said first side of said rectangular wall frame by means of a plurality of wood straps aligned along said height of said frame, and nails through said wood straps, said boardstock and into said stud members.

9. A pre-insulated prefab wall panel as claimed in claim 8 wherein each of said wood straps has pre-drilled holes for receiving said nails, and each of said holes has a third bead of polyurethane foam encircling each of said nails between said each of said wood straps and said boardstock.

10. A pre-insulated prefab wall panel as claimed in claim 9 wherein a diameter of said pre-drilled hole is slightly smaller than a diameter of said nail.

11. A pre-insulated prefab wall panel as claimed in claim 5 further comprising a top plate member affixed in a temporary fashion to said rectangular wall frame over said top rail member, said top plate member being substantially similar in length and cross-section as said top rail member.

12. A pre-insulated prefab wall panel as claimed in claim 1 wherein said boardstock is about 3" thick, and said layer of polyurethane foam has a thickness of about between 1" and 1½".

13. A pre-insulated prefab wall panel as claimed in claim 12 wherein said top and bottom rail members are nominal 2"×4" wood members having a length of about 16 feet, said stud members are nominal 2"×4" wood members spaced apart 16", and a height of said rectangular wall frame is about 95¾".

14. A pre-insulated prefab wall panel for constructing prefab buildings, comprising:

a rectangular wall frame having nominal 2"×4" top and bottom rail members, and a plurality of nominal 2"×4" stud members spaced at about 16" apart and aligned between said top and bottom rail members, said rectangular frame having an overall height of about 95¾" and an overall length of about 16 ft;

an expanded polystyrene boardstock having a thickness of about 3", affixed to a first side of said rectangular wall frame, thereby defining with said top and bottom rail members and said plurality of stud members a plurality of rectangular cavities, wherein each cavity has a depth of a thickness of one of said stud members, said boardstock being affixed to said rectangular wall frame by means of a plurality of wood straps aligned along said stud members, and nails through said wood straps, said boardstock and into said stud members, said boardstock extending along said height of said rectangular wall frame below said bottom rail member a distance of about between 12" and 14", and extending along said height of said rectangular frame above said top rail member a distance of about a thickness of said top rail member;

a layer of polyurethane foam covering a portion of said cavities adjoining said boardstock, said layer of polyurethane foam having a thickness of about between 1" and 1½"; and a top plate member affixed in a temporary fashion to said rectangular wall frame over said top rail member, said top plate member being substantially similar in length and cross-section as said top rail member.

15. A method for manufacturing a prefab wall panel comprising the steps of:

assembling an opened structural wall frame on a horizontal flat surface;

applying a first bead of polyurethane foam on a periphery of said structural wall frame;

covering said structural wall frame with a polystyrene boardstock;

fixing said boardstock to said structural wall frame with strap members and nails through said strap members, said boardstock and into said structural wall frame;

turning said structural wall frame upwardly in a generally vertical orientation;

spraying a layer of polyurethane foam having a thickness of about between 1" and 1½" through said opened structural wall frame and against an underside of said boardstock.

16. A method for manufacturing a prefab wall panel as claimed in claim 15 further comprising the step of predrilling said wood straps with holes having each a diameter smaller than a diameter of said nail.

17. A method for manufacturing a prefab wall panel as claimed in claim 15 wherein said boardstock has two juxtaposed rectangular boards, and wherein a further step comprises the application of a second bead of polyurethane foam along and between the bordering edges of said boards.

18. A method for manufacturing a prefab wall panel as claimed in claim 16 further comprising the step of applying a second bead of polyurethane foam around each of said holes on a surface of each said wood straps adjacent said boardstock.

19. A method for manufacturing a prefab wall panel as claimed in claim 18, comprising the further steps of:

installing a top plate member over a top rail member of said structural wall frame;

placing said boardstock over said structural wall frame such that said boardstock is flush with said top plate member; and turning said structural wall frame in said vertical orientation such that the weight of said structural wall frame rests on said top plate member.

* * * * *